United States Patent [19]

Pickles

[11] 4,099,295

[45] Jul. 11, 1978

[54] A METHOD OF REMOVING A CARDING WEB FROM A CARDING MACHINE

[75] Inventor: John Pickles, Halifax, England

[73] Assignee: Crosrol Limited, Halifax, England

[21] Appl. No.: 653,016

[22] Filed: Jan. 28, 1976

Related U.S. Application Data

[63] Continuation of Ser. No. 442,590, Feb. 14, 1974, abandoned.

[30] Foreign Application Priority Data

Jul. 18, 1973 [GB] United Kingdom ..... 34207/73

[51] Int. Cl.[2] ..... D01G 15/46

[52] U.S. Cl. ..... 19/106 R; 19/65 CR

[58] Field of Search ..... 19/106 R, 65 CR, 98, 19/99, 105

[56] References Cited

U.S. PATENT DOCUMENTS

| | | | |
|---|---|---|---|
| 2,326,331 | 8/1943 | Chantler | 19/150 |
| 2,420,035 | 5/1947 | Fairbairn | 19/65 R |
| 3,249,967 | 5/1966 | Varga | 19/106 R |
| 3,304,582 | 2/1967 | O'Neal et al. | 19/106 R |
| 3,370,326 | 2/1968 | Law | 19/106 R |
| 3,725,975 | 4/1973 | Varga et al. | 19/106 R |
| 3,824,650 | 7/1974 | Watanabe | 19/106 R |

FOREIGN PATENT DOCUMENTS

| | | | |
|---|---|---|---|
| 614,568 | 12/1948 | United Kingdom | 19/65 CR |
| 1,120,222 | 7/1968 | United Kingdom | 19/106 R |
| 1,189,372 | 4/1970 | United Kingdom | 19/98 |

*Primary Examiner*—Dorsey Newton

*Attorney, Agent, or Firm*—Bierman & Bierman

[57] ABSTRACT

A method of removing a carded web of cotton type fibers from a cotton type carding machine which includes the use of spaced apart control rollers for redirecting and controlling the direction of travel of the web.

5 Claims, 1 Drawing Figure

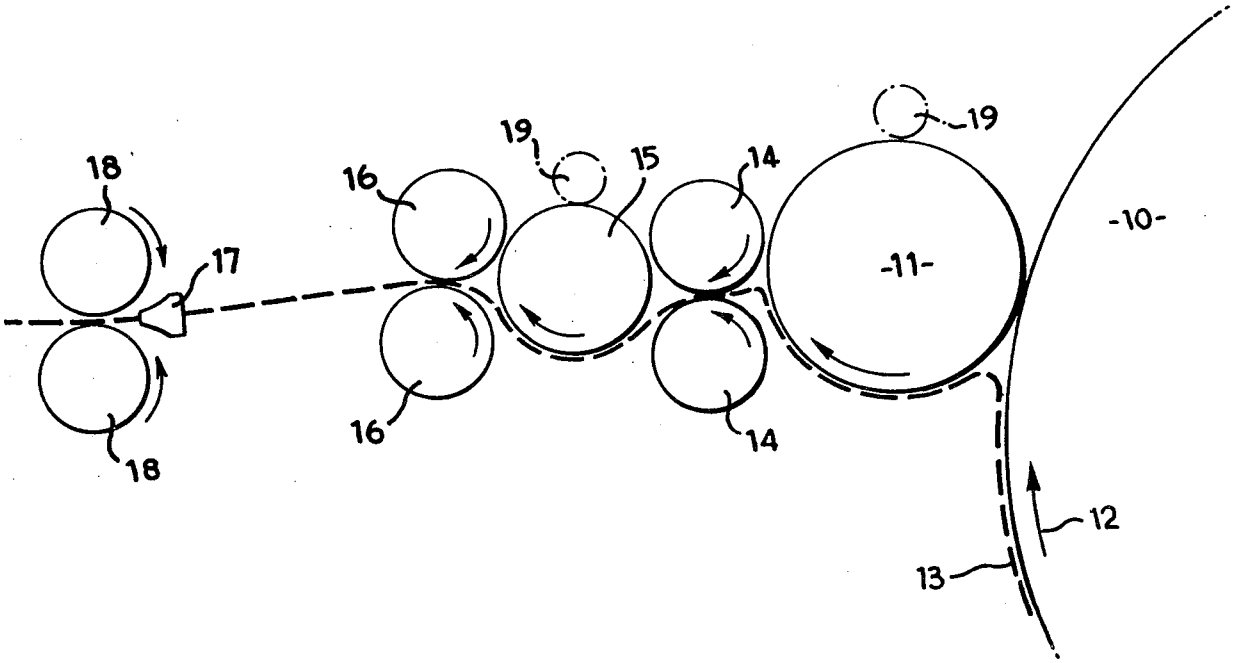
-10-
12
13
19
-11-
14
14
15
19
16
16
17
18
18

A METHOD OF REMOVING A CARDING WEB FROM A CARDING MACHINE

This application is a Rule 60 Continuation of copending Ser. No. 442,590, filed Feb. 14, 1974, now abandoned.

This invention is concerned with textile carding machines and in particular with the removal or stripping of a carded web of fibres from the doffer of a cotton type carding machine.

It has been well known to use a fly comb to strip a carded web from the doffer but one disadvantage of such a stripping comb lies in the fact that it is limited with regard to speed of operation since such a comb is normally oscillated.

More recently it has been known to employ a train of stripping rollers the last one, or ones, of the train being plain surfaced or provided with a somewhat roughened surface, that is to say devoid of any form of card clothing such as flexible wire (fillet) or metallic wire (saw-tooth) card clothing. Stripping roller trains are disclosed in the specification of U.S. Pat. No. 941,843.

When there is provided a pair of plain rollers as the last rollers of a train it is advantageous to apply a considerable pressure between them so as to crush any impurities that protrude from the surfaces of the carded web stripped from the doffer. This practice of applying pressure to the carded web so as to pulverise extraneous matter such as pieces of leaf, seeds and the like does enable web purifying to be effectively carried out when the carding process is carried out in dry conditions and when the cotton to be carded was devoid of specific impurities which when crushed became sticky or exuded sticky matter. However, in humid conditions or when the cotton contained the impurities just referred to, difficulties were experienced in stripping the carded, crushed web from the plain rollers due to the surfaces of such rollers becoming themselves contaminated with the sticky impurities or by running damp due to the humidity in this specification, the term "sticky" is used for convenience to denote cotton which, due to the presence of specific impurities which are sticky when crushed, becomes sticky or exudes sticky matter and also cotton which is damp and exhibits the characteristics of adhering to the rollers of the carding engine. Under these conditions the web tends to stick to the plain rollers and eventually will become broken and thus cause a stoppage with resultant loss of production, wastage of material and increase in the workload of the machine operative. Attempts to maintain the plain rollers in good condition by the use of solvents have not solved the problems because sticky matter dissolved from the plain rollers tends to be deposited onto the carded web giving rise, possibly, to difficulties in the subsequent handling of a silver produced from the web and furthermore running the machine with wet rollers tends to aggravate the tendency of the web to stick to them. Wetting the rollers with solvents gives rise to the creation, to some extent, of a situation analagous to that which exists in mills in which there is no atmospheric control equipment and in which humidity is high and thus the cotton is excessively damp and thus sticks to the plain rollers.

The object of the present invention is to provide an apparatus and a method of operation in which the disadvantages outlined above are overcome or at least substantially mitigated.

Thus according to one aspect of the present invention the method of removing a carded web of fibres in full width from a cotton carding machine includes the steps of stripping the web from a doffer by means of a stripping roller system including a first card clothing covered stripping roller, at least one pair of plain surfaced crushing rollers, a second card clothing covered stripping roller and at least one additional control roller having a plain surface, the web being subjected to drafting between at least the first stripping roller and the pair of plain surfaced crushing rollers.

According to a further aspect of the present invention apparatus for removing a carded web of fibres in full width from a cotton carding machine includes a first stripping roller having a card clothing covered surface, a pair of crushing rollers having plain surfaces, a second stripping roller having a card clothing covered surface and at least one control roller having a plain surface, there being drive means associated with the rollers whereby their speeds of rotation in relation to each other can be varied so as to produce a draft in the full width of the carded web.

The invention will now be described further, by way of example only, with reference to the accompanying diagrammatic illustration of one form of apparatus arranged in accordance with the invention. It will be appreciated that some of the rollers illustrated will be covered with card clothing that may either take the form of flexible wire (fillet) card clothing or metallic wire (saw-tooth) card clothing and that the term 'plain' as used throughout this specification is used in relation to a roller whose surface is devoid of card clothing. Such a roller may have a highly polished surface or a somewhat roughened surface.

As shown in the drawing, a carding machine doffing cylinder 10 has located adjacent to its card clothing covered surface, a first stripping roller 11 which is also covered with card clothing. The doffer 10, as shown by the arrow 12, rotates clockwise as does the first stripping roller so that a carded web 13 of fibres passing under the doffer 10 is stripped and led under the first stripping roller 11.

Adjacent the first stripping roller 11 is a pair of crushing rollers 14 between the nip of which is passed the web 13. The upper roller of the pair of crushing rollers serves to strip the carded web 13 from the first stripping roller 11. The crushing rollers are plain surfaced and preferably have a highly polished hardened surface or alternatively these rollers may have a surface which is roughened by producing very small peripheral grooves thereon. The purpose of these rollers is, not only to strip the web 13 from the roller 11, but also to pulverise any foreign matter such as seed, leaf bits or the like which protrude from the surfaces of the carded web 13. Pressure distribution of the pressure exerted by the crushing rollers should be controlled and distributed and this can be achieved by making the rollers slightly barrel shaped or by having their axes of rotation angled relative to each other at an angle appropriate to the pressure to be applied. It is also possible, and in some cases desirable, to locate a redirecting roller between the stripper roller 11 and the crushing rollers 14.

Adjacent the crushing rollers 14 is a second stripping roller 15 which has its surface covered with card clothing. Downstream of the second stripping roller 15 is a further pair of plain rollers 16 between which is a small gap through which the carded web 13 can pass. In the arrangement as shown the upper roller 16 serves to strip and thus control or redirect, the carded web whilst the lower roller 16 supports it. The gap between control rollers 16 is controlled by means which by way of example can be a support for the bearings of the control rollers that permits movement of one bearing relative to the other.

Up to this point in the apparatus, when in use the carded web has been passed from roller to roller full width. From the rollers 16 the web 13 now passes to a condenser trumpet 17 through which it is drawn, in the form of a sliver, by means of a pair of calender rolls 18. From the calender rolls the sliver is passed in the normal way into a can for storage or further processing.

It is found convenient to provide soft brush rollers 19 for the stripper rollers 11 and 15, such brush rollers, being optional, are shown in broken line in the drawings.

In a modification of the apparatus the second stripping roller 15 is rotatable in the opposite direction to that indicated by the arrow. In this arrangement the web 13 passes over the top of the second stripping roller 15. The optional soft brush roller 19 would, if used, be located below the second stripping roller 15. When the second stripping roller 15 is rotating as just described it is the lower roller 16 of the pair which serves to strip the web 13 and redirect it whilst the upper roller 16 serves to control the web 13 as it passes over the second stripping roller 15.

Whilst the general disposition of the rollers relative to each other has been set out above it is desirable to ensure that the specific setting of the rollers is carefully controlled so that there is, particularly between adjacent card clothing covered rollers, only minimal tendency for the web 13 to be pushed well onto the card clothing thereby rendering stripping more difficult. For this reason it is desirable to set the stripper 11 with its surface in close proximity with the surface of doffer 10. It is also convenient to have these rollers, as shown, rotating in the same sense so that the carded web 13 does not pass over an arc of co-operation between the rollers but is, as shown, stripped by and passed under the roller 11.

It is also convenient to have the teeth of the card clothing, when the latter is wire fillet card clothing, of the roller 11 directed away from the direction of rotation of the roller so as to neutralise the tendency of the card clothing to retain the web. Preferably the draft between these rollers is of the order of 5.0%.

It is also found, in one practical arrangement to have a speed differential between roller 11 and rollers 14 such that there is a draft of about 15%.

The second stripper roller 15 is preferably covered with metallic wire (saw-tooth) card clothing but of course it may be covered with wire fillet card clothing if desired. The draft between rollers 14 and roller 15 is of the order of 9.0% in the case being described.

The surface speed of the roller 16 should preferably be larger than that of roller 15 and should be approximately of the order 3.0%.

As to the percentage drafts given above these are of course only by way of example, and may be varied considerably to suit particular requirements. In addition, whilst the draft between rollers 14 and 18 can conveniently lie between 16 and 22% this can also be varied between considerably broader limits.

Conveniently the diameters of the rollers is as follows:

Roller 11 - 6 inches (to the tips of the card clothing)
Rollers 14 and 16 - 3 inches.
Roller 15 - 4 inches.

One way in which the rollers can be driven is by chain and sprocket and if this drive system is adopted it is convenient to have chain drive connections between sprockets on rollers 11, 14 and 15 at one side of the machine and a drive between rollers 14 and 16 at the other side of the machine. Whilst the sprockets will be changeable to give different percentage drafts one practical arrangement is to provide a 56 tooth sprocket on roller 11, a 22 tooth sprocket on the lower roller 14 (and a meshing pair of 24 tooth pinions for the two rollers 14) and a 27 tooth sprocket on roller 15.

A single ⅜ inch pitch chain wraps the sprockets of rollers 11 and 15 and passes over an arc of contact with the sprocket of roller 14.

The sprocket for rollers 14 and 16 (that is at the other side of the apparatus) respectively have 26 teeth and 23 teeth and again conveniently the chain is ⅜ inch pitch.

Clearly the diameters of the rollers and the number of teeth on the sprockets is only given by way of example and these can be varied to suit individual requirements.

Preferably the rollers of the whole trains are cleaned from time to time to remove any adherent foreign matter; this can be done by periodically presenting wire brushes to the rollers to remove the contamination or by applying chemical solvents. Clearly the periods of time between cleaning operation will vary dependent upon the amount of contamination in the cotton stock.

What we claim is:

1. A method of removing a carded web of cotton type fibers in full width from a cotton type carding machine comprising stripping said web from a doffer by means of a first card clothing covered stripping roller adjacent said doffer, said web adhering to said first stripping roller, passing said web through a pair of crushing rollers adjacent said first stripping roller, said crushing rollers pulling said web from said first stripping roller, said web sticking to said crushing rollers, then passing said web partially around said second card clothing covered stripping roller, said second stripping roller pulling said web from said crushing rolls, said web sticking to said second stripping roller, feeding said web between a pair of spaced apart control rollers which pull said web from said second card clothing covered stripping roller and direct and control the direction of travel of the web, said control rollers being spaced apart sufficiently to prevent said web from sticking to said spaced apart control rollers.

2. The method in claim 1 wherein the web is subjected to drafting between the first stripping roller and the second stripping roller.

3. The method in claim 1 further comprising the step of feeding the web from the control rollers to a pair of calender rollers.

4. The method in claim 3 further comprising the step of feeding the web to the calender rollers through a condenser element.

5. The method in claim 3 wherein the web is subjected to drafting between the control rollers and the calender rollers.

* * * * *